US005237787A

United States Patent [19]

Grether, deceased et al.

[11] Patent Number: 5,237,787

[45] Date of Patent: Aug. 24, 1993

[54] GLAZING ELEMENT

[75] Inventors: Paul W. Grether, deceased, late of Seuzach, by Edith né Göhring Grether, heir; Tina Grether, heir, Kollbrunn; Moritz Grether-Escher, heir, Wintertur; Michael Grether, heir, Seuzach, all of Switzerland

[73] Assignee: Geilinger AG, Winterthur, Switzerland

[21] Appl. No.: 743,159

[22] Filed: Aug. 9, 1991

[30] Foreign Application Priority Data

Aug. 10, 1990 [CH] Switzerland ..... 2612/90

[51] Int. Cl.[5] ..... E06B 7/12

[52] U.S. Cl. ..... 52/171; 52/789; 52/790

[58] Field of Search ..... 52/789, 790, 172, 222, 52/171; 160/378

[56] References Cited

U.S. PATENT DOCUMENTS 4,166,345 9/1979 Becker ..... 52/789
4,242,386 12/1980 Weinlich .
4,334,398 6/1982 Grether ..... 52/789
4,520,611 6/1985 Shingu et al. ..... 52/789

FOREIGN PATENT DOCUMENTS 0034813 9/1981 European Pat. Off. .
2352124 12/1977 France .
2420014 11/1979 France ..... 52/172
2537109 8/1984 France .
588627 4/1977 Switzerland .
589889 7/1947 United Kingdom .

OTHER PUBLICATIONS

International Search Report CH 261290.

*Primary Examiner*—Carl D. Friedman
*Assistant Examiner*—Christopher Kent
*Attorney, Agent, or Firm*—Tarolli, Sundheim & Covell

[57] ABSTRACT

The glazing element is provided with at least one tensioned insulation form (2) between two panes (1). Spring elements (3) secured to a tension profile (4) serve to place the film under tension. The spring elements are distributed over the entire film periphery. They are also elastically bendable in all directions transverse to their elongation, and are secured with their longitudinal direction essentially perpendicular to the film plane with one end at the film and the other end secured to the tension profile In this manner, the spring elements can elastically follow relative shape alterations of the film with respect to the tension profile by bending transversely to their longitudinal direction. In this novel construction, tension forces are distributed in all directions in the insulation film. No friction forces need to be overcome in order to tension the film. The entire tension taken up by the film support is so small that it is possible simply to adhere the tension profile inwardly to the panes. Simple helical coils can be used as the spring elements

18 Claims, 1 Drawing Sheet

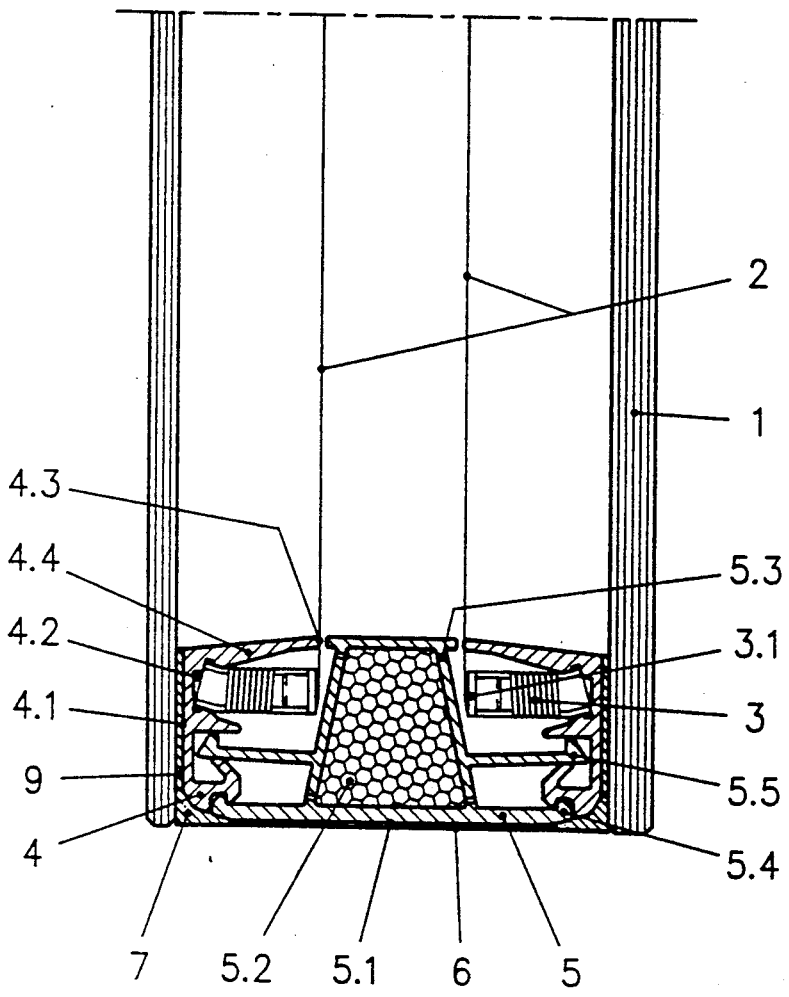
2
1
4.3
4.4
5.3
4.2
3.1
4.1
3
9
5.5
4
5.4
7
5.2
5.1
6
5

GLAZING ELEMENT

TECHNICAL AREA

This invention relates to a glazing element with at least one insulation film stretched out between two panes, in which spring elements secured to a tension profile are used to stretch the film, the spring elements being longitudinally extended between two ends.

STATE OF THE ART

A glazing element of this kind is, for example, known from the Belgian patent No. 86727. In this known element, a film is looped around a bar in the lower portion of the element. Its two free end edges are secured to the frame in the upper portion of the element, in parallel, spaced relation to each other. The two halves of the film are held under tension by spring elements in the form of helical compression springs. The latter press at one end inwardly against a rectangular tension profile, and press at the other end against the heads of screws which on the one hand are screwed through the film into the bar, and on the other hand project into the tension profile. The just mentioned screws extend centrally through the compression springs. The longitudinal or axial direction of the springs corresponds to the direction of the tension on the film. In any event, temperature-dependent length changes in the films or film halves can be balanced out by the known construction. Simultaneously appearing width changes cannot be compensated, nor can an unequal alteration of the two films.

In the CH patent 653404, there is described a self-supporting insulation element with an insulation film for insertion between the panes of a compound window, in which length and width alterations in the film are taken into account. Here the film is biaxially stretched on a rectangular tension frame so as to be movable relative to the frame. The side portions of the tension frame are pre-bent to one side in the unloaded condition corresponding to the desired film tension. The movability of the film with respect to the tension frame comes about through a discontinuous attachment of the film to four slip-bands, which are flexible in the longitudinal direction of the side of the frame, and are displaceably guided longitudinally with respect to the side of the frame. Because of the friction between the slip-bands and the guiding means on the tension frame, this construction results in an increase in the total tension which is supported by the tension frame. In order to tension the film and maintain it in taut condition, this friction must be continuously overcome. In order that the reaction forces arising from the tension of the film do not affect the edge joint between the tension frame and the two panes, the edge joint incorporating adhesive and serving the purposes of sealing, the tension frame is constructed in a self-supporting manner.

DESCRIPTION OF THE INVENTION

The aim of the invention is to provide a glazing element of the previously described kind, in which the insulation film is maintained crease-free under any kind of shape alterations, particularly those arising from thermal expansion, and even differential thermal expansion between the film and the frame, throughout a broad temperature range of at least −40° C. to +60°, the glazing element being simpler in its construction and capable of manufacture with less material and a lower production cost.

According to the invention, this aim is attained in a glazing element having the characteristics of claim 1. Accordingly, in the glazing element according to the invention, the spring elements are distributed over the entire film periphery. They are elastically bendable in all directions transverse to their longitudinal extent, and are disposed with the longitudinal extent substantially perpendicular to the plane of the film, with one end secured to the film and the other end secured to the tension profile, this being done in such a way that the spring elements can elastically follow relative shape changes in the film with respect to the tension profile by bending transversely to their longitudinal direction.

In the new construction, tension forces are applied in a distributed manner on all edges of the insulation film. The tensioning does not require any friction forces to be overcome. The entire tension supported by the film mounting can therefore be considerably smaller then with the known construction. It is not necessary to construct a self-supporting frame. By means of the spring elements, manufacturing tolerances are to a large extent automatically balanced. In a preferred embodiment of the invention, the span profiles are directly adhered to the inside of the panes. Relatively simple tension profiles can be used, and cheap helical springs can be utilized as spring elements.

Further advantages and refinements of the invention are characterized in the appended claims.

BRIEF DESCRIPTION OF THE DRAWING

The invention will be described in greater detail below utilizing an example embodiment illustrated in the attached drawing. FIG. 1 is a cross-section of the lower portion of a glazing element with two similarly tensioned insulation films, constructed in accordance with the invention. Where portions are identical on both sides of the mid-plane due to the symmetry of the construction about the mid-plane, only one such portion is provided with a numeral.

HOW TO CARRY OUT THE INVENTION

In the drawing the numeral 1 identifies two flat glass panes parallel to each other. Between the panes 1 there are provided two insulation films 2, also parallel to each other and parallel to the panes. Helical springs 3 serve to support and tension the films 2. The helical springs are oriented, in the sense of their axial elongation between their two ends, essentially perpendicular to the plane of the films 2, and are anchored at one end (foot portion) in tension profiles 4. At the other ends (head portion) they are secured to the respective insulation films 2 in the edge zones thereof. The tension profiles 4 have flat side surfaces 4.1 where they are adhered by adhesive layer 9 to the inside of the panes 1. By means of a separation profile 5, the tension profiles are held at a uniform spacing. Exteriorly (below in the drawing) the spacing profile 5 has a flat outer surface 5.1, of which the width substantially spans across the space between the panes 1, and a sealing band 6 is applied to the outer surface 5.1 as a vapour barrier. In the spacing profile 5 there is formed a longitudinal chamber 5.2 which is somewhat trapezoidal in cross-section and is filled with a drying agent, the longitudinal chamber 5.2 being in communication with the interior window space through small openings 5.3.

Weld-caps 3.1 serve to connect the heads of the helical springs 3 with the insulation films 2, the weld-caps 3.1 being constituted by a material which is fusible with the film material, the weld-caps 3.1 further being inserted in the head ends of the helical springs 3. The insulation films 2 are spot-welded to the weld-caps 3.1. The turns of the coil springs 3 lie continuously at least partly in contact with each other. Thus they are not compressible under pressure, and do not deflect during application of the welding contact, for example, using an automatic ultrasonic spot-welder.

What cannot be seen in the sectional drawing is the distribution of a plurality of helical springs 3 around the entire periphery of the insulation films 2. The helical springs 3 can be provided either at equal spacings, or with an increasingly closer spacing adjacent the corner regions With the latter there arises a more advantageous tension distribution in the film surface than is attained with equal spacing. A suitable average spacing between helical springs for a polyester film with a thickness of 75 micrometers is approximately 5 cm.

The length of the helical springs 3 is roughly three times their diameter.

In the tension profiles 4, the helical springs 3 are anchored in a longitudinal groove 4.2 with undercut flanks. For this purpose, the last turn in the foot portion of the helical springs is somewhat enlarged with respect to the remaining turns, and the enlarged turn locks itself into the undercuts of the longitudinal groove 4.2. By this kind of securement, the foot portion end of the helical springs 3 is mechanically secured to the tension profiles 4, while the opposing head-portion end, secured to the insulation film, is freely movable in all directions. The helical springs 3 can thus follow and/or compensate virtually all shape alterations of the insulation films 2 with respect to the tension profiles 4.

As an example, aluminum can be used as the material for the tension profile However, the use of plastic is of advantage due to its significantly smaller thermoconductivity.

As can be clearly seen in the drawing, the helical springs 3 are bent transversely with respect to their longitudinal extension, because of the necessary prestressing of the insulation film 2. In order that the springs 3 can be situated roughly perpendicular to the films 2, they are secured into the tension profiles 4 in a somewhat angulated manner with respect to the planes of the films.

The turns of the helical springs 3, due to the spring being bent transversely to their longitudinal extent, are partially raised or separated from one another, and exhibit, at the inside edge of the bend, essentially only point contact with each other. Therefore, lateral form alterations of the insulation films 2 in the longitudinal direction of the tension profile result only in frictionless turning- or tilting-movements of the individual turns about these point contacts.

The forward edges 4.3 of the illustrated leg flanges 4.4 of the tension profiles 4 serve to clearly fix the positions of the film planes. The connection locations between the insulation films 2 and the helical springs 3 are somewhat rearwardly offset with respect to these edges 4.3.

The side surfaces 4.1 of the tension profile 4, used as attachment surfaces, are formed with a relatively large surface in order to ensure a stable adhesion. A suitable adhesive is, for example, an acrylate contact adhesive, which can be applied to the flat side surfaces 4.1 of the tension profile 4 in the form of a mounting adhesive band provided with a protective strip, prior to the actual assembly of the adhesive joint.

The thickness, the elasticity and the creep characteristics of the adhesive layer 9 are so selected that the layer is able to elastically absorb shear forces which are caused by transient unequal thermal expansions of the panes and the tension profile, or by corresponding mechanical shocks. On the other hand, the adhesive layer does not exhibit any creep under the effect of the latent foil tension. Preferably, the thickness of the adhesive layer corresponds roughly to the maximum expected relative displacement between the panes and the tension profile.

The possibility of providing the connection between the tension profiles 4 and the panes 1 as a load-supporting joint is a direct consequence of the use of helical springs 3 for tensioning the films 2 in the described manner, because in this manner practically no friction forces need to be overcome in tensioning the films. Because of the low overall tension, it is also not necessary to construct the tension profiles 4 as a load-bearing tension frame. It is even possible to combine several tension profiles around the periphery of the insulation films without direct connection with each other and with equalization gaps between pairs of adjacent ends. An embodiment for a rectangular window which is advantageous from a sealing point of view, includes the combination of two U-shaped bent tension profiles, because the abutment locations between them occur at two longitudinal sides of the rectangular section, and not at the corners where sealing considerations are critical.

The spacing profile 5 is attached to both tension profiles 4 in the manner of a tongue and groove joint, in which spring flanges 5.5 prevent the independent release of the connection.

For appearance reasons inter alia, the leg flanges 4.4 of the tension profiles, and the upper wall of the longitudinal chamber 5.2 of the spacing profile 5 facing the interior of the glazing element, are provided with flat surfaces at the same height and with small mutual spacing. Between them there is left only a small gap for the passage of the insulation films 2.

The sealing band 6 is a band of rust-proof (austenitic) stainless steel with a thickness of 0.05 mm. A butyl adhesive that softens at high temperature for adhering the sealing band between the panes. In contradistinction to the adhesive used for adhering the tension profiles, the butyl adhesive does not need to resist any forces. In the edge regions adjacent the panes, the configuration of the spacing profile and the tension profiles provides longitudinal grooves 7, as is clearly seen in the drawing. The adhesive can flow into these longitudinal grooves 7, and can tightly seal the gaps between the spacing profile 5 and the tension profiles 4, as well as between the latter and the panes. Aside from these edge regions, no adhesive connection is provided between the spacing profile 5 and the sealing band 6.

The above described glazing element is notable for its simple construction. Above all, the helical springs are markedly cost-advantageous parts. The window can be manufactured with low construction costs and in only a few working steps that can be automated.

Naturally, changes are possible with respect to the described example embodiment. For example, one of the two insulation films 2 can be omitted. Instead of helical springs it is possible to use other spring elements with similar spring characteristics, for example a flat spring twisted together through 90°, or resilient tongues formed directly on the tension profile. Instead of using welding, the films can be connected to the helical springs or other employed spring elements utilizing adhesive.

What is claimed is:

1. A glazing element, comprising:

at least one flexible insulation film, two panes, tension profiles, and spring elements;

said film having a periphery and being stretched in a plane between said two panes;

said tension profiles having leg flanges defining a frame;

said plane in which said film is stretched being defined by said leg flanges;

each of said spring elements having a first end and a second end, each of said spring elements being elongate between said first and second ends, a respective direction of said elongation for each spring element being essentially perpendicular to said plane in which said film is stretched, each of said spring elements being elastically bendable in all directions transverse to said respective direction of elongation;

said spring elements being supported from said tension profiles for tensioning said film;

said spring elements being distributed over the entire film periphery;

said first end of each of said spring elements being individually secured to said film and said second end of each of said spring elements being secured to said tension profiles such that each of said spring elements elastically follows relative size alterations of said film, with respect to said tension profiles, be bending transversely to said respective direction of elongation;

said spring elements being tension springs and having a plurality of turns, each of said turns being at least partially engaged with an adjacent turn; and said spring elements being located outside said frame defined by said leg flanges.

2. A glazing element according to claim 1, characterized in that at least some of said spring elements being elastically bent at a right angle to said respective direction of elongation by said film.

3. A glazing element according to claim 1 or claim 2, characterized in that each of said spring elements have a longitudinal extent along said respective direction of elongation and a width measured at a right angle to said respective direction of elongation, 'said longitudinal extent being substantially three times greater than said width.

4. A glazing element according to claim 1, characterized in that said spring elements are at equal spacings from each other along said film periphery.

5. A glazing element according to claim 1, characterized in that said film having a plurality of corners defined along said film periphery, adjacent spring elements being spaced a distance apart along said film periphery, said distance between said adjacent spring elements being diminished for spring elements located adjacent to said corners.

6. A glazing element according to claim 1, characterized in that said spring elements are helical springs.

7. A glazing element according to claim 6, characterized in that each of said helical springs having a welding cap, said welding cap being made of a material fusible with said film, and said film being welded to said welding cap.

8. A glazing element according to claim 6, characterized in that each helical spring has a last turn at the first end, said last turn being enlarged with respect to other turns of said respective helical spring, said last turn being inserted in a longitudinal groove of the tension profile, said groove having undercut flanks.

9. A glazing element according to claim 6, characterized in that each of said turns of each helical spring engages adjacent turns along an inward side of said respective helical spring.

10. A glazing element according to claim 1, characterized in that said film being stretched over an edge on each of said tension profiles, said second end of each of said spring elements being offset from said edge toward said first end of said respective spring element.

11. The glazing element according to claim 1, characterized in that each of said tension profiles being adhered to an inward side of one of said panes.

12. A glazing element according to claim 11, characterized in that each of said tension profiles being adhered to said one of said panes utilizing an adhesive layer, said adhesive layer having a thickness, an elasticity and a creep propensity such that said adhesive layer equalizes transient shear forces created by unequal thermal expansion between said panes and said tension profiles or through corresponding mechanical shocks, said adhesive layer not exhibiting any creep as a result of the effect of a latent existing film tension.

13. A glazing element according to claim 1, including a spacing profile for spacing said two panes apart, said spacing profile being connected to at least one of said tension profiles.

14. A glazing element according to claim 13, characterized in that said spacing profile having a longitudinal chamber filled with a drying agent, said longitudinal chamber being in communication with a space between said two panes.

15. A glazing element according to claim 14, characterized in that said film being stretched over an edge on each of said tension profiles, said edge on each of said profiles being an edge of said leg flange, said leg flange having a flat interior surface adjacent to said interior space of said glazing element, said spacing profile having a flat interior surface adjacent to said interior space of said glazing element, said interior surface of said leg flange being coplanar with said interior surface of said spacing profile, said interior surface of said leg flange being spaced from said interior surface of said spacing profile to permit passage of said film.

16. A glazing element according to claim 13 including a sealing band, said sealing band being sealingly and adhesively secured as a vapor barrier around said spacing profile between said two panes.

17. A glazing element according to claim 1, wherein said film being a first film, said tension profiles being first tension profiles and said spring elements being first spring elements, including a second insulation film, second tension profiles and second spring elements;

said second film being stretched in a plane between said first film and one of said panes, said plane in which said second film is stretched being defined by said leg flanges of said second tension profiles;

each of said second spring elements having a first end and a second end, each of said second spring elements being elongate between said first and second ends, a respective direction of said elongation for each of said second spring elements being essentially perpendicular to said plane in which said second film is stretched, each of said second spring elements being elastically bendable in all directions transverse to said respective direction of elongation of said second spring elements;

said second spring elements being supported from said second tension profiles for tensioning said second film;

said second spring elements being distributed over the periphery of said second film;

said first end of each of said second spring elements being individually secured to said second film and said second end of each of said second spring elements being secured to said second tension profiles such that each of said second spring elements elastically follow relative size alterations of said second film, with respect to said second tension profiles, by bending transversely to said respective direction of said elongation;

said second spring elements being tension springs and having a plurality of turns, each of said turns being at least partially engaged with an adjacent turn; and said second spring elements being located outside said second frame defined by said leg flanges of said second tension profiles.

18. A glazing element comprising:

a first pane extending in a first plane, said first pane having an outer peripheral edge;

a second pane extending in a second plane which is parallel to said first pane and spaced from said first pane, said second pane having an outer peripheral edge;

an insulation film extending substantially parallel to said first and second planes and being located between said first and second panes; said insulation film having an outer peripheral edge;

flange means attached to said first pane adjacent to said outer peripheral edge of said first pane, said flange means bordering along the outer peripheral edge of said first pane, said flange means extending from said first pane toward said second pane, said flange means having a flange edge, said flange edge being located between said first and second panes, said insulation film extending means across said flange edge and engaging said flange edge;

tension means for maintaining said insulation flange taut, said tension means including a plurality of tension springs for pulling said insulation film across said flange edge, said plurality of springs being coil springs said plurality of springs being located outwardly of said flange edge, each of said springs having first and second ends, said first end of each of said springs being secured to said flange means;

said second end of each of said springs being secured to said insulation film at a location adjacent to said outer peripheral edge of said insulation film, each of said coil springs having a longitudinal extent which is transverse to the first plane, said second end of each of said springs being resiliently deflected toward said flange edge during tensioning of said insulation film.

* * * * *